US005692981A

United States Patent [19]

Whisman

[11] Patent Number: 5,692,981

[45] Date of Patent: Dec. 2, 1997

[54] GAME PUCK

[76] Inventor: John L. Whisman, 8173 Frankel La., Sebastopol, Calif. 95472

[21] Appl. No.: 537,318

[22] Filed: Sep. 29, 1995

[51] Int. Cl.[6] ..... A63B 71/00

[52] U.S. Cl. ..... 473/588

[58] Field of Search ..... 273/128 R, 128 CS, 273/128 A; 473/588, 589

[56] References Cited

U.S. PATENT DOCUMENTS

| | | | |
|---|---|---|---|
| D. 374,897 | 10/1996 | Whisman | D21/203 |
| 2,704,211 | 3/1955 | Decepoli | 273/128 R |
| 3,675,928 | 7/1972 | Gentile . | |
| 3,997,164 | 12/1976 | White, Sr. . | |
| 4,078,801 | 3/1978 | White, Sr. . | |
| 5,149,096 | 9/1992 | Keating et al. . | |
| 5,240,251 | 8/1993 | Filice | 273/128 R |
| 5,269,520 | 12/1993 | Vellines . | |
| 5,288,072 | 2/1994 | Hsieh | 273/128 R |
| 5,330,184 | 7/1994 | Douglas . | |
| 5,346,214 | 9/1994 | Bruhm . | |
| 5,348,298 | 9/1994 | Montgomery | 273/128 R |
| 5,366,219 | 11/1994 | Salcer et al. . | |

*Primary Examiner*—Raleigh W. Chiu
*Attorney, Agent, or Firm*—Janis Biksa; Owen, Wickersham & Erickson

[57] ABSTRACT

This invention relates to a game/hockey type puck which utilizes a friction reducing top and bottom surface to reduce the amount of friction and wear when the puck is used on non-ice playing surfaces. In addition a series of side, wing type, slots are provided which aerodynamically enhance the stability of the puck as it travels through the air when hit by a player. Two wing slots or a complete peripheral slot may be provided. The outer cylindrical surface of the puck is curved so that it easily falls over during playing and this curved surface can have several radiuses so that the extreme outermost portion of the curve on which the puck would roll is offset from the central plane of the puck to aid it in tipping over if it was rolling on end. The side friction reducing surfaces of the puck protrude slightly from the sides of the rubber type pucks so that the leading edge of the friction reducing surface is the first to contact and be effected by a variation in the surface quality of the playing surface.

10 Claims, 4 Drawing Sheets

GAME PUCK

The Applicant claims priority from eariler application Ser. No. 29/041,470 filed on Jul. 11, 1995, issued as U.S. Pat. No. D374,897, on Oct. 22, 1996.

FIELD OF THE INVENTION

This invention relates to hockey pucks and more particularly, to those types of hockey and game pucks which are used on non-ice surfaces such as concrete, asphalt and other similar playing surfaces where roller (blade) hockey is played.

BACKGROUND OF THE INVENTION

This invention relates to the construction of a hockey-type puck which can be used on non-ice surfaces to play roller hockey. Such pucks have been constructed in the past with materials which wear easily and thereby cause a deterioration in the consistency of the puck's sliding performance. Such pucks are harder to push over the surface and do not slide as easily or consistently when passed or shot by a player. The configuration of a standard hockey puck—a short fat cylinder—which is wonderful when sliding on ice where there is a low coefficient of friction between the flat side of the puck and the ice, is not so wonderful when the same configuration is slid across playing surfaces having various different coefficients of friction. Under such circumstances, when a puck is struck by a player's stick, the natural horizontal attitude of the puck is disturbed as the puck is jarred to be guided and/or accelerate in a different direction. As the puck moves in the new direction, only a portion of the puck contacts the surface across which the puck is traveling and creates as drag. If the coefficient of friction of the surface across which the puck is traveling is high (a rough surface), it is possible that the one edge of the puck will dig in and cause the puck's path to veer from the path intended by the player, and/or that the puck will become unstable and tumble as it continues its forward motion, and/or that the puck will change its attitude and start to roll on its edge and will continue to roll until it is stopped by a player's stick or other barrier.

Each of the above-described situations causes the puck to veer from the path intended by the guiding or striking player. Such veering increases the level of skill needed by a roller hockey player to manipulate, pass, and shoot the puck and also introduces an undesirable element of uncertainty into the game which can prevent a player from receiving consistent feedback on his or her improving skills in the game. Such pucks veer inconsistently and non-uniformly and the amount (degree) of veer may vary, depending on how much the surface or edges of the puck have been worn. At the semi-professional or professional level of roller hockey it is extremely desirable that the skills of the players be the determining factor in puck control and ultimately game winning performance. The small differences in the skill of the players at the semi-pro and pro levels cannot be consistently exhibited when the performance exhibited by a puck is erratic and inconsistent.

It is desirable to eliminate the inconsistencies in the puck's performance to improve the roller hockey game at both the beginner and professional levels so that a player's skill and experience in guiding and striking a puck will determine the outcome of a game, rather than the erratic performance and squirreliness in the motion of a game puck whose motion is inconsistent even when it is struck consistently time after time.

SUMMARY OF THE INVENTION

This invention provides an improved game puck for use in ice and non-ice surface games where a puck is used.

A puck (game projectile) according to the invention is provided with a projectile body generally in the shape of a short fat cylinder which is constructed of a non-elastic rubber based material. A set of top and bottom friction reducing member (disks) are attached to the top and bottom surfaces of the projectile body. In one instance, the disks are held to the rubber body by adhesives. In another they are injection molded to and through the rubber body. The friction reducing covering is, preferably, an ultrahigh molecular weight polyethylene which is particularly well suited to abrasion resistance and slides easily on most surfaces because it has a low coefficient of friction. The game projectile is configured so that the friction reducing members (disks) extend above the top and bottom edges of the projectile body. Under normal game conditions when sliding flat, only such a friction reducing member is in contact with the playing surface and its leading edge is also the first to contact variations in the playing surface across which it is traveling.

The perimeter surface (outside of the cylinder) is not vertical as in most prior hockey-type pucks but is rounded with knurled surface treatment. The rounded surface reduces the likelihood that the puck will continue to roll when it unintentionally comes up and starts rolling.

In another configuration according to the invention, the convex curve of the perimeter surface is formed with two radiuses of curvature. The two radiuses of curvature intersect at and provide a high point offset from a central plane (parallel to the top and bottom surfaces) of the puck. With such a configuration, when the puck is rolling along the playing surface, the offset of the plane of rolling contact from the puck's center of gravity cause the puck's rolling (vertical) position to be unstable and causes the puck to immediately start falling over. The offset high point on the perimeter surface causes the puck to fall over more rapidly than when the center of the curve is at the central plane of the puck or when the perimeter surface is a straight vertical line with square edges. Additional stability and consistency is thereby achieved by the high point offset from the central plane of the projectile body.

In another configuration according to the invention the stability of the puck is enhanced by providing wing slots in the side of the puck. The slots generally parallel to the top and bottom surfaces of the puck. These wing slots channel air as the puck moves through the air. The channeling of this air provides a change in the aerodynamic pressure distribution due to air resistance across the puck, releasing high pressure at the front of the puck through the puck to cause a continuous (or alternating) stabilizing effect (the puck generally spins as it travels across the playing surface) when a continuous perimeter slot is used the stabilizing effect can be considered to be "continuous", when a set of winged slots is used the effect can be considered to be "alternating". This is in contrast to the destabilizing effect caused by the force of air resistance which tends to increase the instability of a conventional puck which has been jarred out of its perfect horizontal attitude by a player when it is hit. The jarring action together with the surface friction and air resistance forces cause the puck to roll and tumble, often uncontrollably, after it is struck by a player. In contrast, a puck according to the present invention with wing grooves in its sides, tends to be more stable and/or stabilize more quickly after it is jarred into motion, than a puck of conventional design.

Such a puck with wing grooves can also be equipped with a rounded perimeter surface with two or more radiuses producing a high point on the surface offset from the central plane of the body to gain full advantage of features according to the invention.

Another configuration according to the invention provides a continuous substantially centered slot around the perimeter of the puck providing a larger continuous slot space for the passage of air during the puck's movement.

Other configurations according to the invention include the use of raised buttons on the surface friction reducing members of the puck which come in contact with the playing surface, where those buttons can be rounded or kidney-shaped protrusions.

The present invention provides increased stability by reducing the frictional force between the puck and the playing surface and also increases the longevity of such a puck using a highly durable surface material. The stability of the puck during play is enhanced by the use of side slots either wing slots or a continuous peripheral slot which reduce the buildup of high pressure in front of the puck as it moves across and helps to stabilize the puck as it travels through the air and across the playing surface. The edges of the game puck are rounded so that the puck is easily knocked down if it does not fall down by its own imbalance and such a characteristic is further enhanced by placing the high point of radial curvature displaced from the center of gravity, such that a puck will not roll straight but will immediately roll into a tight circle and fall over. The friction reducing surfaces of the puck protrude slightly above the edge of the rubber body of the puck such that when traveling across the playing surface the friction reducing surface and its leading edge are the first to contact any variations in the playing surface such that the rubber body is less likely to catch on such variations in the playing surface and a more consistent and self-stabilizing puck motion is observed when a puck is struck in a consistent manner by a player. This leads to more enjoyment of the game for the players and a more consistent outcome in that the players with the higher level of skill will generally produce game results which are consistent with their performance and are not dependent on the anomalies of an erratic and unreliable puck motion.

DETAILED DESCRIPTION

Figure 1:
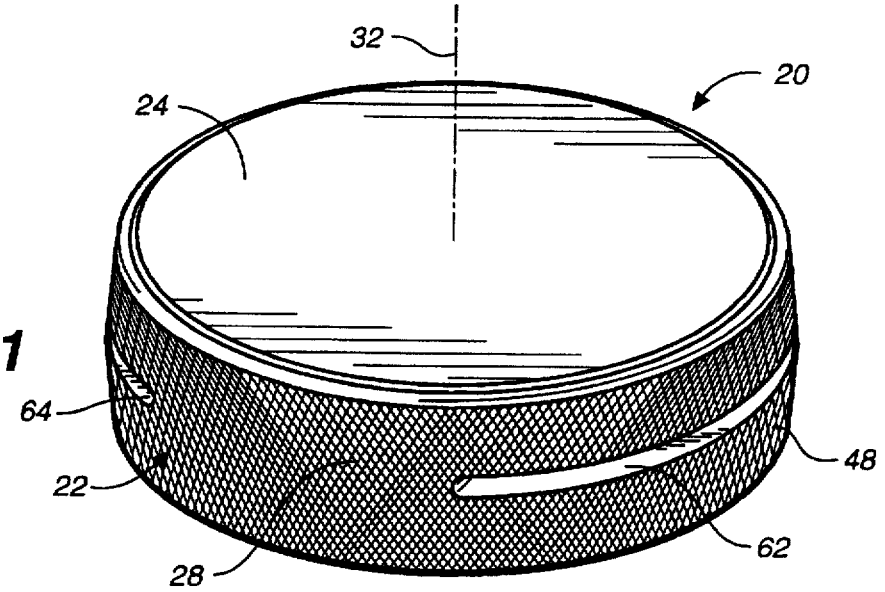
FIG. 1 is a perspective view of a game puck according to the invention.
Figure 2:
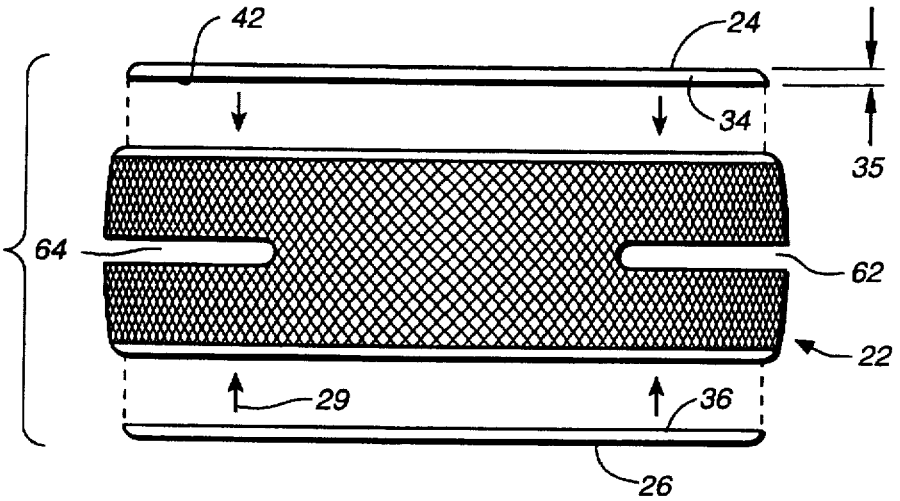
FIG. 2 is an elevational exploded side view of a game puck according to the invention.

A perspective drawing of a game puck according to the invention is shown in FIG. 1. The game puck (projectile) 20 includes a cylindrical projectile body 22 with a friction reducing disk 34 having a top surface 24. A central cylindrical axis 32 passes down through the center of the cylinder. The outside-perimeter surface 28 of the cylindrical projectile body 22 has a knurled finish 48. Wing slots 62, 64 are shown cut into the side of the game projectile 20 generally along its central plane.

The game projectile 20 of FIG. 1 is generally constructed in one of two ways. The cylindrical projectile body 22 made of a non-marking dead (non-resilient) rubber (for example, can be purchased from Rubber Development at 701 Technology Plaza, Waverly Plaza, Waverly, Iowa 50677-1417, item number RD217). The top and bottom surfaces of the rubber body 22 include slight recesses (such as 23 shown by the dashed line) in FIG. 5) to receive the top and bottom friction reducing disks 34, 36 (preferably made of a very high molecular weight (VHMW) polyethylene such as Hoechst Celanese Hostalloy™ 731; for example from Guttenberg Industries, 511 Herder Street, Guttenberg, Iowa 52052) which can be in a variety of colors and can be attached to the cylindrical projectile body 22 by an adhesive 42 (for example 3M hot melt adhesive). The arrows 29 show the direction of assembly once adhesive is positioned in the space. The back side of the top and bottom friction reducing disks 34, 36 (the side opposite the outer surfaces 24, 26 can be etched or otherwise roughened to enhance the mechanical adhesion of the adhesive. The thickness 35 of the top and bottom friction reducing disks 34, 36 is approximately 0.125 inches or 0.090 inches. The depth of the recess 23 (FIG. 5) in the top and bottom of the cylindrical projectile body 22 is approximately 0.060 inches. Therefore the top edge of the friction reducing disks protrude at least 0.030 inches and as much as 0.065 inches beyond the top edge of the cylindrical projectile body 22. Other dimensions are discussed below.

Figure 3:
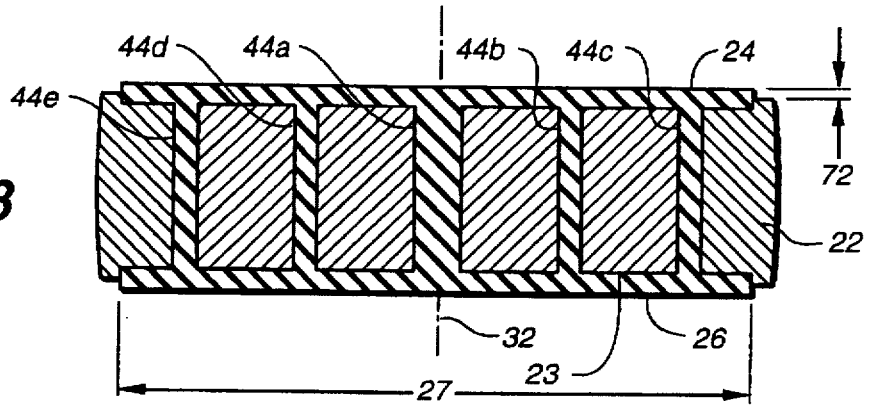
FIG. 3 is a cross-sectional view of a complete game puck of the type whose body is picture in FIG. 4 taken at 3—3.
Figure 4:
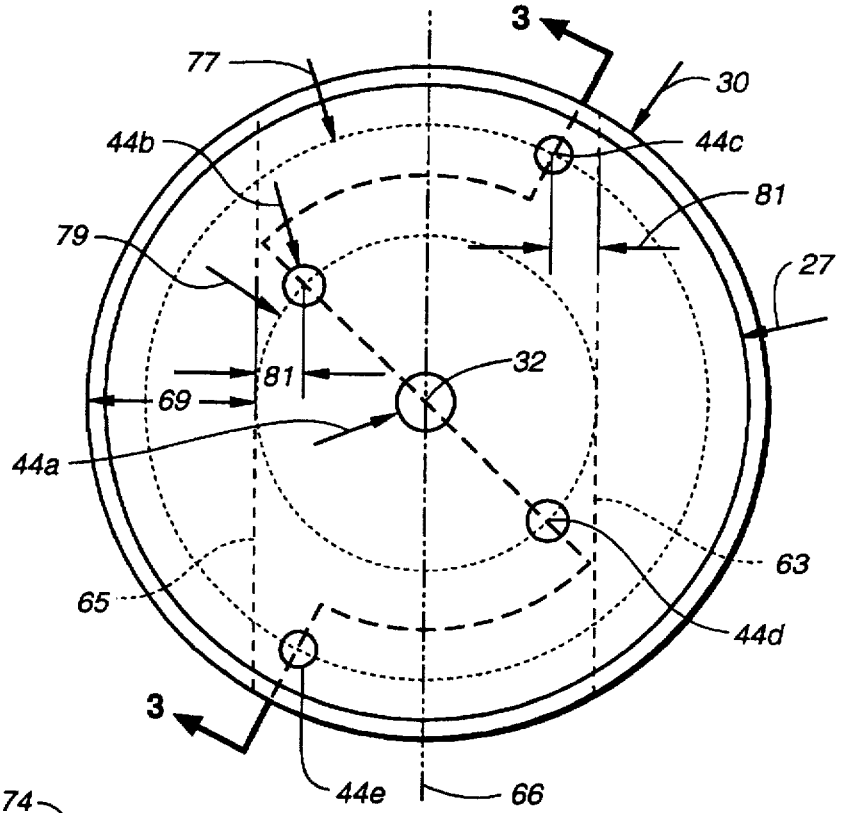
FIG. 4 is a top view of a rubber body portion of a game puck according to the invention.

FIG. 3 shows a cross-sectional view of a game puck of FIG. 4. The top and bottom friction reducing disks 34, 36 are part of a single injection mold which creates the top and bottom friction reducing disks and also connecting passages 44*a*, 44*b*, 44*c*, 44*d*, 44*e* between the top and bottom surfaces. As can be seen in the body diagram of FIG. 4, the cross-section cut 3—3 is constructed to pass through each one of the passages from the top to the bottom surface of the cylindrical projectile body 22 without passing through a wing slot. The diameter of the outer passages 44*b*, 44*c*, 44*d*, 44*e* is approximately 0.152 inches while the diameter of the central passage 44*a* connecting the top and bottom surfaces is approximately 0.250 inches. The location of the outer passages 44*c* and 44*e* are located along a circle 77 having a diameter of 2.431 inches. The internal cross-passages 44*b* and 44*d* are located on an inner circle 79 having a diameter of approximately 1.50 inches. The through passage 44*a* is located at the center of the cylindrical projectile body 22 and parallel to its central cylindrical axis 32 (also see FIG. 1).

Figure 5:
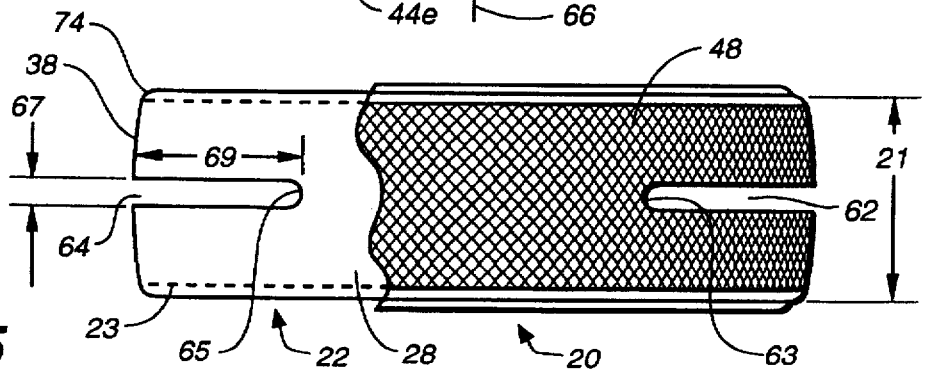
FIG. 5 is a front view of the game puck of FIG. 4, where for increased clarity the surface knurling and top and bottom friction reducing members are not shown on the left side of the jagged line.

The through holes 44b, 44c, 44d, 44e are located a distance 81 (0.220 inches) from the bottom line 63, 65 of the side wing slots 62, 64. The through holes can also be configured in other locations as appropriate for injection molding design. The side wing slot bottoms 63, 65 are parallel to a wing slot axis 66 which runs perpendicular to the central cylindrical axis 32. The depth 69 of the side wing slot as shown in FIGS. 4 and 5 is approximately 0.75 inches from the extreme outer perimeter surface while the width of the side wing slot 67 is approximately 0.125 inches. The radius at the bottom line 65 of the side wing slot is 0.0625 which provides a circular bottom groove for the side wing slot. The surface recess 23 has a diameter 27 of 2.660±0.005 inches. The outside diameter 30 of the cylindrical projectile body is approximately 3±0.005 inches.

As can be seen in FIG. 5 the knurled finish 48 (60 degree angle with 0.030" spacing 0.010" deep) is provided on the perimeter surface 28 and the perimeter surface 28 is contoured in a uniform cross-sectional convex curve 38 having a 2.5 inch radius. The upper corner transitioning from the peripheral surface 28 to the top surface of the cylindrical projectile body 22 has a radius 74 of 0.125 inches.

Figure 6:
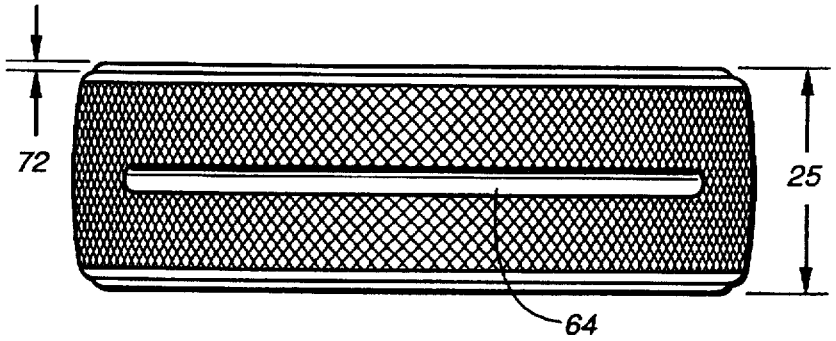
FIG. 6 is a side view of a complete game puck of the type whose body is pictured in FIG. 4.

The thickness 21 of the cylindrical projectile body is 0.90 inches (FIG. 5) and the thickness of the overall game projectile 25, as shown in FIG. 6 is 1±0.020 inches. Note that the friction reducing disks protrude from the surface a distance 72 (which as discussed above can vary from 0.030 to 0.065 inches).

Figure 7:
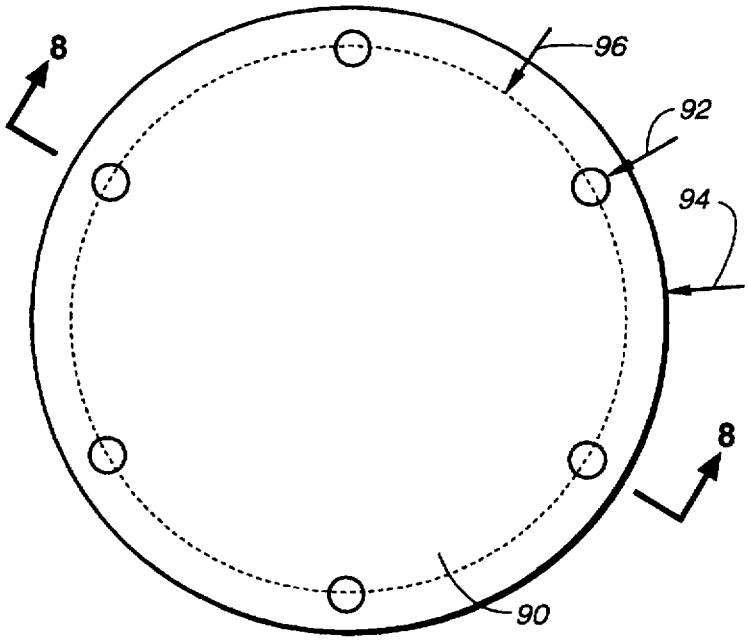
FIG. 7 is a top view of a round button surface plate for use with a rubber body according to the invention.

FIG. 7 shows a top view of a round button surface plate 90. This surface reducing plate is similar to the surface reducing plates earlier discussed except that the plate has a series of rounded buttons 92 on its surface. These buttons are approximately 0.188 inches in diameter and are situated on a circle having a dimension of 2.375 inches. The diameter of the plate 94 is approximately 0.266±0.005 inches.

Figure 8:
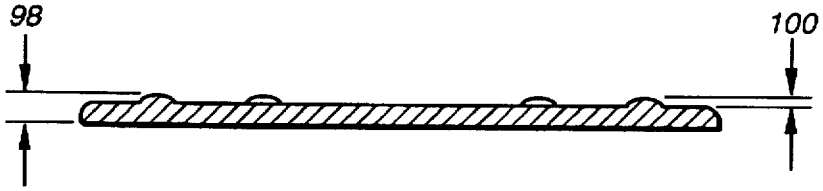
FIG. 8 is a cross-sectional view of FIG. 7 taken at 8—8.

FIG. 8 shows a cross-section of FIG. 7 taken at 8—8 showing that the overall height of the disk 98 to the top of the circular protrusions is approximately 0.133 and that the height of the circular protrusion or button 100 is approximately 0.041 inches.

Figure 9:
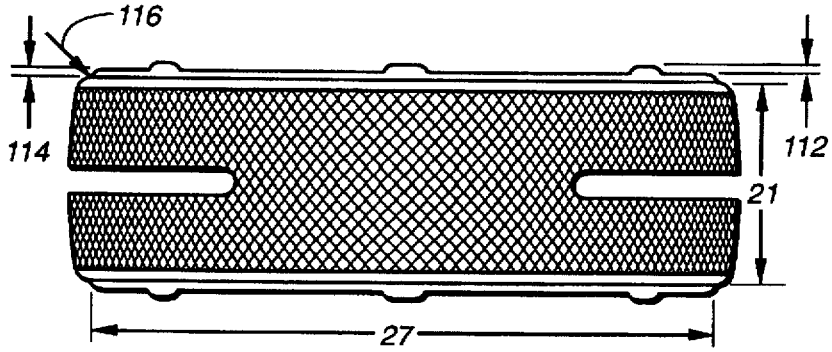
FIG. 9 is a front view of a game puck according to the invention equipped with kidney-shaped projections on its surface members.
Figure 10:
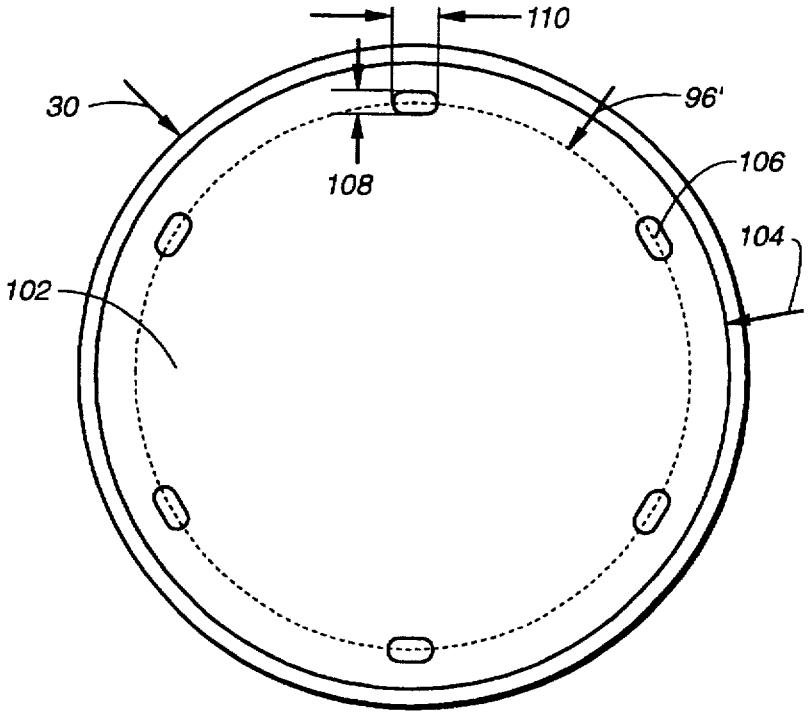
FIG. 10 is a top view of a game puck according to the invention showing the kidney-shaped projections on the top of the surface member shown in FIG. 9.

FIG. 9 shows another configuration according to the invention wherein the friction reducing plates on the surface of the cylindrical projectile body are constructed of kidney-shaped projections positioned along a circle 96' of the kidney-shaped surface plate 102. The kidney-shaped projections protrude a distance 112 (0.041 inches) above the top of the plate 102. In its assembled position, the top of the plate 102 protrudes a dimension 114 (0.032 inches) above the thickness 21 (0.90 inches) of the cylindrical projectile body 22. The dimension 27 of the recess for receiving the friction reducing disk is discussed above. The radius at the edge of the friction reducing disk is 0.063 inches. The outside diameter 30 of the cylindrical projectile body 22 remains unchanged. The location of the kidney-shaped buttons 106 is on the imaginary circle 96' as discussed above and located at 6 locations around the perimeter. The kidneys have a thickness 108 of 0.125 inches and a length 110 of 0.274 inches. The corners are radiused at 0.063 inches. As constructed here the outer diameter 104 of the friction reducing disk is 2.646±0.005 inches.

Figure 11:
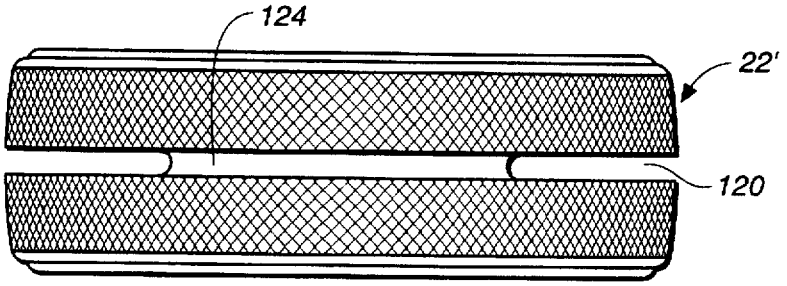
FIG. 11 is a front view of a game puck according to the invention having a peripheral slot completely surrounding the puck at its central plane.
Figure 12:
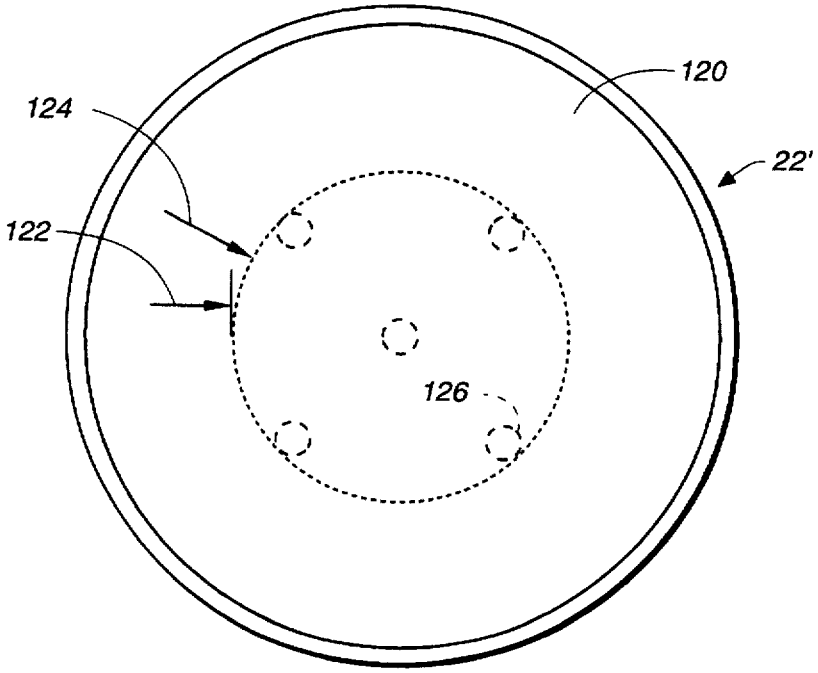
FIG. 12 is a top view of the game puck of FIG. 11.

FIG. 11 shows a front view of another embodiment according to the invention showing a continuous peripheral slot 120 around a central hub 124 of the cylindrical projectile body 22'. The only difference between this and the previously described projectile bodies is that the peripheral slot is continuous around the central axis of the projectile body 22' and as shown in the top view of FIG. 12 it has a central hub diameter 122 of approximately 1.5 inches. Also, for the purpose of injection molding a series of through holes 126 can be provided.

Figure 13:
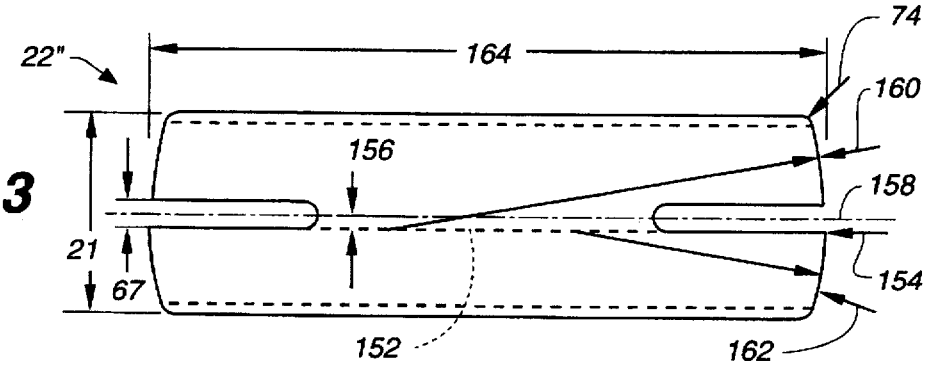
FIG. 13 is a cross-sectional view showing the details of a rubber body having the high point of its outer curvature offset from the central plane of the puck with two different radiuses of curvature on the arcs on either side of the high point.

FIG. 13 shows an alternate configuration of a peripherally curved surface of a game puck according to the invention. The thickness 21 of the cylindrical projectile body 22" and the width 67 of the wing slots is equidistant about a central plane 158 of the game projectile. The game projectile still having a overall outside diameter (of 3 inches) at its outermost point 154 the convex surface is located offset a distance 156 of approximately 0.0625 inches or 1/16 of an inch) from the central plane 158. The curvature of the upper portion of the cylindrical projectile body 22" as shown in FIG. 13 is taken with its center along the offset plane 152 with a radius 160 of approximately 1.998±0.005 inches. This dimension will provide a slightly gentler curve between a set diameter of the top of the puck and the extreme outermost point 154 along the convex shaped peripheral surface. In contrast the lower portion of the peripheral surface will also have its central point of radius along the offset plane 152 and will form an arc 162 having a radius of 1.089 inches between the preset dimension at the bottom of the puck and the extreme outermost point 154 which reduces the outermost diameter 164 (3 inches) of the puck. In this configuration the top and bottom surfaces of the puck are identically dimensioned and only the curved convex shaped side surfaces are different in that they have two radiuses and the radiuses can provide a smooth transition between the edge of the top and bottom and the high extreme outermost point 154 which forms a offset plane 152 offset by a dimension 156 from the central plane 158 along which the center of gravity is generally located. Although less aesthetically attractive, a sharp transition to an off set high point can also be provided. If such a puck were to begin rolling on its peripheral surface its point of contact would be along the offset plane 152 and since the center of gravity is generally along the central plane 158 the puck would tend to immediately fall over rather than continue rolling.

While the invention has been described with regards to specific embodiments, those skilled in the an will recognize that changes can be made in form and detail without departing from the spirit and scope of the invention.

I claim:

1. A game projectile comprising, a substantially cylindrical projectile body having a top surface disposed substantially parallel to and a predetermined distance from a bottom surface, said top and bottom surfaces being disposed substantially perpendicular to a central cylindrical axis of said body, a perimeter surface of the body spanning between said top surface and said bottom surface;

a top friction reducing member substantially covering and being fixed to said top surface;

a bottom friction reducing member substantially covering and being fixed to said bottom surface;

wherein said perimeter surface forms a substantially uniform cross sectional contour turned around said central cylindrical axis, wherein said cross sectional contour is a substantially convex curve facing away from said central cylindrical axis;

wherein the radius of curvature of the substantially convex curve includes more than one radius of curvature.

2. A game projectile comprising, a substantially cylindrical projectile body having a top surface disposed substantially parallel to and a predetermined distance from a bottom surface, said top and bottom surfaces being disposed substantially perpendicular to a central cylindrical axis of said body, a perimeter surface of the body spanning between said top surface and said bottom surface;

a top friction reducing member substantially covering and being fixed to said top surface;

a bottom friction reducing member substantially covering and being fixed to said bottom surface;

wherein said perimeter surface forms a substantially uniform cross sectional contour turned around said central cylindrical axis, wherein said cross sectional contour is a substantially convex curve facing away from said central cylindrical axis;

wherein a set of the extreme outermost points of the convex curve forming the convex surface are located offset from a central plane of said game projectile perpendicular to said central cylindrical axis.

3. A game projectile comprising, a substantially cylindrical projectile body having a top surface disposed substantially parallel to and a predetermined distance from a bottom surface, said top and bottom surfaces being disposed substantially perpendicular to a central cylindrical axis of said body, a perimeter surface of the body spanning between said top surface and said bottom surface;

a top friction reducing member partially covering and being fixed to said top surface; and a bottom friction reducing member partially covering and being fixed to said bottom surface;

wherein said perimeter surface includes two wing slots each slot extending substantially perpendicular to said central cylindrical axis and substantially parallel to said top and bottom members, said slots each having a depth running substantially parallel to and spaced a predetermined distance from a wing slot axis which is located near and is substantially perpendicular to said central cylindrical axis, wherein said perimeter surface forms a substantially uniform cross sectional contour turned around said central cylindrical axis, wherein said cross sectional contour is a substantially convex curve, wherein the radius of curvature of the substantially convex curve includes more than one radius of curvature.

4. A game projectile as in claim 3, wherein a set of the extreme outermost points of the convex surface are located offset from a central plane of said game projectile perpendicular to said central cylindrical axis.

5. A game projectile comprising, a substantially cylindrical projectile body having a top surface disposed substantially parallel to and a predetermined distance from a bottom surface, said top and bottom surfaces being disposed substantially perpendicular to a central cylindrical axis of said body, a perimeter surface of the body spanning between said top surface and said bottom surface;

a top friction reducing member substantially covering and being fixed to said top surface, substantially all of a top of said friction reducing member forming a continuous layer on said top surface of said body extending away from said body, such that said game projectile when resting on its top surface rests only on said top surface of the friction reducing member and does not contact said body until substantial erosion of the top surface occurs;

a bottom friction reducing member substantially covering and being fixed to said bottom surface, substantially all of a bottom of said friction reducing member forming a continuous layer on said bottom surface of said body extending away from said body, such that said game projectile when resting on its bottom surface rests only on said bottom surface of the friction reducing member and does not contact said body until substantial erosion of the bottom surface occurs, wherein said perimeter surface forms a substantially uniform cross sectional contour turned around said central cylindrical axis, wherein said cross sectional contour is a substantially convex curve, wherein the radius of curvature of the substantially convex curve includes more than one radius of curvature.

6. A game projectile as in claim 5, wherein a set of the extreme outermost points of the convex surface are located offset from a central plane of said game projectile perpendicular to said central cylindrical axis.

7. A game projectile comprising, a substantially cylindrical projectile body having a top surface disposed substantially parallel to and a predetermined distance from a bottom surface, said top and bottom surfaces being disposed substantially perpendicular to a central cylindrical axis of said body, a perimeter surface of the body spanning between said top surface and said bottom surface;

a top friction reducing member substantially covering and being fixed to said top surface, substantially all of a top of said friction reducing member forming a continuous layer on said top surface of said body extending away from said body, such that said game projectile when resting on its top surface rests only on said top surface of the friction reducing member and does not contact said body until substantial erosion of the top surface occurs;

a bottom friction reducing member substantially covering and being fixed to said bottom surface, substantially all of a bottom of said friction reducing member forming a continuous layer on said bottom surface of said body extending away from said body, such that said game projectile when resting on its bottom surface rests only on said bottom surface of the friction reducing member and does not contact said body until substantial erosion of the bottom surface occurs, wherein said perimeter surface includes two wing slots each perpendicular to said central cylindrical axis and parallel to said top and bottom members, said slots each having a depth running parallel to and spaced a predetermined distance from a wing slot axis which passes through and is perpendicular to said central cylindrical axis, wherein said perimeter surface forms a substantially uniform cross sectional contour turned around said central cylindrical axis, wherein said cross sectional contour is a substantially convex curve, wherein the radius of curvature of the substantially convex curve includes more than one radius of curvature.

8. A game projectile as in claim 7, wherein a set of the extreme outermost points of the convex curve forming the perimeter surface are located offset from a central plane of said game projectile perpendicular to said central cylindrical axis.

9. A game projectile comprising, a substantially cylindrical projectile body having a top surface disposed substantially parallel to and a predetermined distance from a bottom surface, said top and bottom surfaces being disposed substantially perpendicular to a central cylindrical axis of said body, a perimeter surface of the body spanning between said top surface and said bottom surface;

wherein said perimeter surface forms a substantially uniform cross sectional contour turned around said central cylindrical axis, wherein said cross sectional contour is a substantially convex curve;

wherein the radius of curvature of the substantially convex curve includes more than one radius of curvature.

10. A game projectile as in claim 9, wherein a set of the extreme outermost points of the convex curve of the perimeter surface are located offset from a central plane of said game projectile perpendicular to said central cylindrical axis.

* * * * *